United States Patent [19]

Theurer et al.

[11] 4,046,077

[45] Sept. 6, 1977

[54] TRACK RENEWAL METHOD AND APPARATUS

[75] Inventors: Josef Theurer, Vienna; Manfred Brunninger, Linz, both of Austria

[73] Assignee: Franz Plasser Bahnbaumaschinen-Industriegesellschaft m.b.H., Vienna, Austria

[21] Appl. No.: 702,031

[22] Filed: July 2, 1976

[30] Foreign Application Priority Data

July 11, 1975 Australia ..... 5389/75

[51] Int. Cl.[2] ..... E01B 29/02

[52] U.S. Cl. ..... 104/2; 104/6

[58] Field of Search ..... 104/2, 3, 5, 6, 9; 198/629, 561; 214/83.36

[56] References Cited

U.S. PATENT DOCUMENTS

| | | | |
|---|---|---|---|
| 3,330,219 | 7/1967 | Plasser et al. | 104/2 |
| 3,388,784 | 6/1968 | Gartner | 198/629 X |
| 3,654,868 | 4/1972 | Plasser et al. | 104/2 |
| 3,685,456 | 8/1972 | Plasser et al. | 104/2 |
| 3,699,894 | 10/1972 | Plasser et al. | 104/2 |

FOREIGN PATENT DOCUMENTS

| | | | |
|---|---|---|---|
| 805,075 | 11/1958 | United Kingdom | 104/2 |

*Primary Examiner*—Robert J. Spar
*Assistant Examiner*—Randolph A. Reese
*Attorney, Agent, or Firm*—Kurt Kelman

[57] ABSTRACT

A track renewal train comprised of a plurality of rail freight cars has coupled to its last car a bridge-like car having at respective ends thereof a rail-bound front undercarriage and a rail-bound rear undercarriage, and a track-laying bogie running on the ballast bed intermediate the undercarriages, the bridge-like car being supported with the front undercarriage on a track consisting of old ties and rails, on which the train moves in a working direction, and with the bogie on the ballast bed. Hoists are mounted on the bridge-like car for lifting separated sections of the old track and the lifted track sections are conveyed to selected freight cars. Simultaneously, new ties stored on the freight cars are conveyed against the working direction to the bridge-like car, successive new ties are lowered from the bridge-like car to the ballast bed, which has previously been planed, between the bogie and the rear undercarriage, the lowered new ties are laid on the planed ballast bed, new rails are laid on the new ties and fastened thereto.

6 Claims, 3 Drawing Figures

Figures 1, 2, 3:
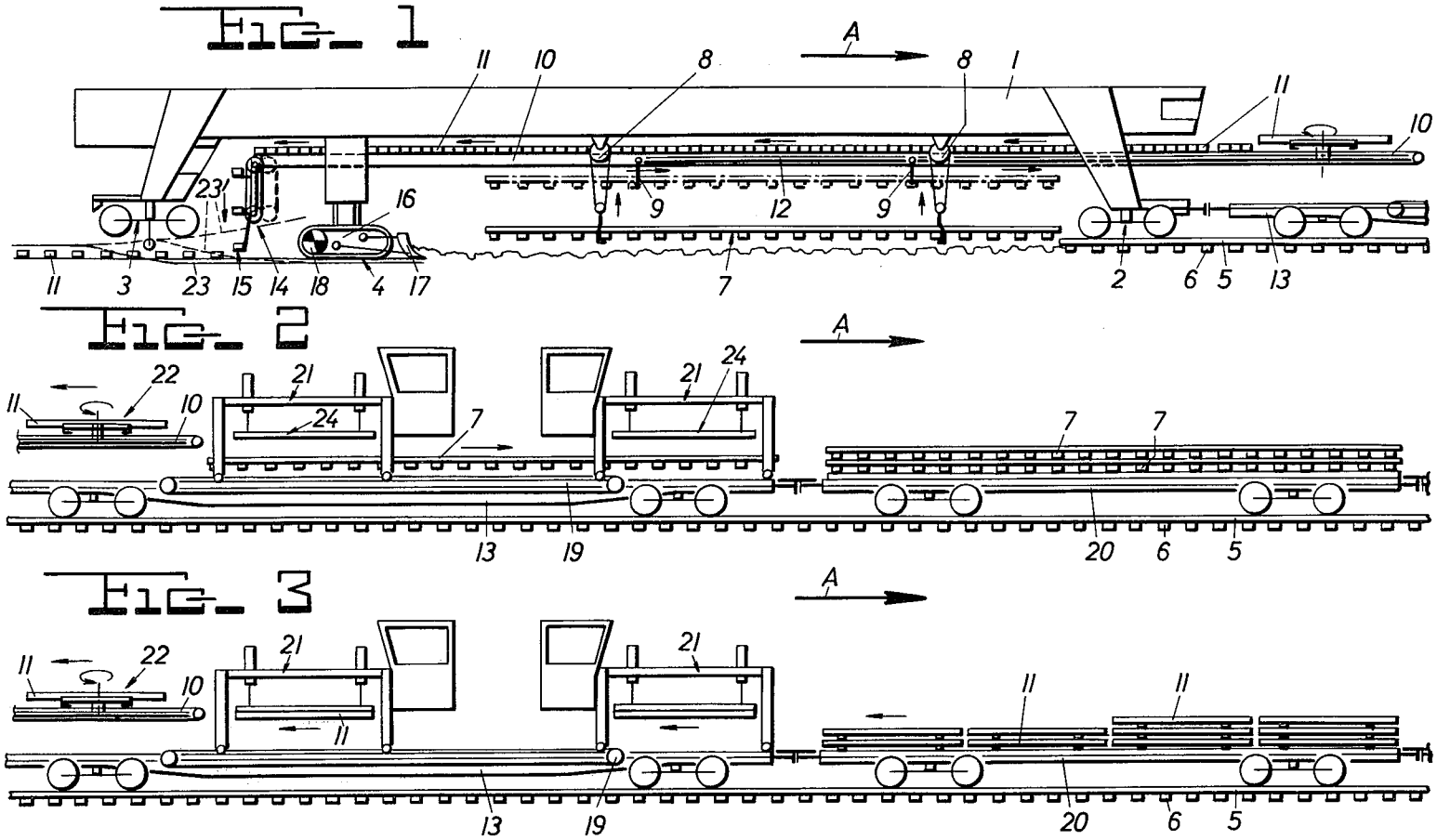

A
A
A

TRACK RENEWAL METHOD AND APPARATUS

The present invention relates to improvements in a method and apparatus for track renewal wherein a track consisting of old ties and rails is replaced by a track consisting of new ties and rails resting on a ballast bed.

British Pat. No. 805,075, published Nov. 26, 1958, discloses a track renewal train which comprises a bridge-like car coupled to a plurality of freight cars. The bridge-like car has means for lifting sections of the old track off the ballast bed and for conveying these old track sections away to selected ones of the freight cars. There, the old track sections are separated into their component parts. At the same time, track components of a new track are assembled on the freight cars into sections of new track which are conveyed back to the bridge-like car from where they are laid on the previously planed ballast bed. To plane the ballast bed, a plow and a retractable roller are mounted on the bridge-like car ahead of its rear undercarriage, the roller being pressed down into planing engagement with the ballast bed and thus raising the rear undercarriage of the bridge-like car off the track. This track renewal requires a very considerable number of freight cars for storing, dismantling and assembling track sections, as well as suitable apparatus for dismantling and assembling the track section components. Any malfunctioning will reduce the speed of the operation which is accordingly low, causing extended dead times on the track. Furthermore, forward movement on the planing roller, even over previously smoothed ballast beds, is quite slow and the entire renewal train is quite unstable on such a roller support which tends to sink into the ballast bed.

It is the primary object of this invention to make a track renewal operation of this type more efficient and faster while simplifying and reducing the size of the track renewal train.

The above and other objects are accomplished in accordance with the method of the invention by moving a train of rail freight cars in a working direction over the track consisting of old ties and rails. A bridge-like car having at respective ends thereof a rail-bound front undercarriage and a rail-bound rear undercarriage, and a bogie running on the ballast bed intermediate the rail-bound undercarriages is coupled to a last one of the freight cars. The bridge-like car is supported with the front undercarriage on the track consisting of old ties and rails and with the bogie on the ballast bed. The track consisting of old ties and rails is separated into sections between the front undercarriage and the bogie, the track sections are lifted off the ballast bed onto the bridge-like car and the lifted track sections are conveyed in the working direction from the bridge-like car to selected ones of the rail freight cars. New ties are stored on the rail freight cars and successive ones of the new ties are simultaneously conveyed from selected rail freight cars against the working direction to the bridge-like car. The successive new ties are lowered from the bridge-like car to the ballast bed between the bogie and the rear undercarriage and the new rails are laid on the new ties between the bogie and the rear undercarriage, and the new rails are fastened to the new ties.

The track renewal train of the present invention comprises a plurality of rail freight cars including a last freight car movable in a working direction over the track consisting of old ties and rails, new ties being stored on selected ones of the freight cars, a bridge-like car coupled to the last freight car and having at respective ends thereof a rail-bound front undercarriage and a rail-bound rear undercarriage, a bogie running on the ballast bed intermediate the rail-bound undercarriages, and the bridge-like car being supported with the front undercarriage on the track consisting of old ties and rails and with the bogie on the ballast bed. The train includes means for transporting the lifted track section in the working direction from the bridge-like car to a selected one of the freight cars and an endless conveyor means is mounted on the bridge-like car above the track section transporting means for conveying a succession of stored new ties against the working direction. The endless conveyor means has a front end projecting forwardly of the bridge-like car over the last freight car and a rear end extending to a region between the bogie and the rear undercarriage. Means mounted in this region is arranged to lower the conveyed new ties successively onto the ballast bed in selected spacing, and means is provided for planing the ballast bed before the ties are laid.

Such a method and train enable the separated track sections to be rapidly lifted and transported away while the new ties and rails may be equally rapidly laid since no assembly has to be effected on the train. This substantially increases the speed of the track renewal operation and avoids malfunctions which may block the continuous operation. The new rails may be moved onto the new ties either from storage laterally adjacent the track or they may be conveyed from the freight cars to the region between the bogie and the rear undercarriage in a manner known, for instance, from U.S. Pat. Nos. 3,807,310, dated Apr. 30, 1974, or 3,699,894, dated Oct. 24, 1972. The new rails are then fastened to the new ties in an independent operation. The method and apparatus of this invention have the additional unexpected advantage of enabling the rail freight cars used for transporting the track sections to be used for coming back loaded with new ties after they have taken away, say six or seven, track sections, instead of returning empty. Preferably, the bridge-like car is so arranged and dimensioned that a number of new ties corresponding to three to four track sections may be successively laid in one continuous operation so that new rails having a length of 120 m may be laid in sections.

The track renewal train is of relatively simple construction since it requires only conveyor means for the ties independent of the rails and rail freight cars used in other types of track renewal operations may be utilized in such a train. The means for lowering and laying the ties is also relatively simple and enables this operation to be effected rapidly and synchronously with lifting the old track section off the ballast bed. The track renewal train is so simple and fast that it may be used for the rapid renewal of even very short track renewal sites.

The above and other objects, advantages and features of the present invention will become more apparent from the following detailed description of a now preferred embodiment of a track renewal train, taking in conjunction with the accompanying drawing showing a schematic side elevational view of the train, wherein FIG. 1 illustrates the bridge-like car coupled to the last rail freight car of the train;

FIG. 2 illustrates the continuation of the train of FIG. 1, with the last freight car and a succeeding freight car carrying the track sections; and FIG. 3 illustrates the continuation of the train of FIG. 1, with the last freight car and a succeeding freight car storing the new ties.

Referring now to the drawing, FIG. 1 shows bridge-like car 1 having at respective ends thereof rail-bound front undercarriage 2 and rail-bound rear undercarriage 3, and bogie 4 which is not bound to a track and runs on the ballast bed intermediate rail-bound undercarriages 2 and 3, bogie 4 being much closer to the rear than to the front undercarriage. As shown, bridge-like car 1 is supported with the front undercarriage on the track consisting of old ties 6 and old rails 5, and with bogie 4 on the ballast bed. The illustrated bogie is a selectively retractable track-laying vehicle and carries a ballast bed planing plow 17 attached to the front of the vehicle. The ballast planing effect is increased by mounting vibrator 18 on the vehicle. As appears from the drawing, when the retractable track-laying vehicle is extended into engagement with the ballast bed, rear undercarriage 3 is lifted off the track to enable the new track to be laid. When vehicle 4 is retracted, car 1 will be supported at its rear by undercarriage 3.

The track consisting of old ties and rails is separated in track sections 7, which comprise two lengths of rails fastened to a plurality of ties, between front undercarriage 2 and bogie 4. Hoists 8 are mounted on car 1 for lifting track section 7 off the ballast bed into engagement with conveyor hooks 9 which are affixed to the lower course of endless conveyor band 10 for transporting the lifted track section (see chain-dotted lines in FIG. 1) in working direction A of the train in guide path 12 from bridge-like car 1 to a selected one of the freight cars, i.e. rail freight car 20 shown in FIG. 2. In the illustrated embodiment, the hoists are fixedly mounted on car 1 but, obviously, the hoists may be combined with hooks 9 for movement in the working direction. The upper course of endless conveyor band 10 constitutes an endless conveyor means for conveying a succession of stored new ties 11 against the working direction above guide path 12. The endless conveyor band has a front end projecting forwardly of bridge-like car 1 over last freight car 13 and a rear end extension to region 15 between bogie 4 and rear undercarriage 3. Means 14 is mounted on car 1 in region 15 for lowering the conveyed new ties 11 successively onto the ballast bed in selected spacing, the bed having been planed first by preceding plow 17 and track-laying vehicle 4. Tie lowering and laying means in track renewal trains are well known and illustrated means 14 includes an endless vertical conveyor having support plates extending therefrom for receiving the ties from endless conveyor band 10 and dropping them on the planed ballast bed.

The illustrated track-laying vehicle, with its plow and vibrator, assures a particularly stable and relatively rapid forward movement of the train during the renewal operation and the coupling of the plow to the vibrating vehicle provides a very smooth ballast bed.

FIG. 2 shows the last rail freight car 13 to which bridge-like car 1 is coupled. This is a flat car on which there is mounted endless conveyor band 19 for transporting track sections 7 in working direction A, the endless conveyor band receiving the track sections from car 1 and transporting them to succeeding car 20 where these sections are stored. Obviously, additional flat cars 20 may be provided and they may also carry conveyors for transporting of track sections to succeeding cars so that any desired number of track sections may be stored and transported on the train. Flat car 13 also carries transport frames 21 which run on rollers in guide tracks on car 13 so that they may be readily moved in or against the working direction. The transport frames have tools 24 enabling them selectively to carry new ties 11 or track section 7 for conveying the same. Turntable 22 is associated with endless tie conveyor band 10 for turning the new ties 90° from a conveying direction extending in the direction of the track, as the new ties come from storage on freight cars 20 (see FIG. 3) to a laying direction extending transversely to the track, as they are conveyed by conveyor band 10 to tie lowering and laying means 14. This structure simplified the conveying arrangement coniderably. FIGS. 2 and 3 show the same structure, the rail freight car 20 being alternatively used for storing the old track sections and new ties.

The track renewal method with the use of the illustrated train will be explained hereinbelow.

As successive sections 7 of old track are replaced by new track, the train including rail freight cars 20, last freight car 13 and bridge-like car 1 is advanced intermittently in working direction A, the freight cars running on old track 5, 6 and car 1 being supported with front undercarriage 2 on the old track and with track-laying vehicle 4 on the ballast bed, while plow 17 smoothes the bed during the advancement of the train. Each separate track section 7 is lifted by hoists 8 and transported on hooks 9 to conveyor band 19 and transport frames 21 which move the track sections for storage to flat car 20. While only one such car is shown in the drawing, a plurality of storage rail cars will be provided. At the beginning of the track renewal operation, most or all of these cars 20 will be loaded with new ties 11. As the operation proceeds track section by track section, stored new ties will be conveyed to region 15 where they are laid and successive emptied freight cars 20 will be loaded with old track sections. Thus, the delivery of new ties and the removal of the old track proceeds in a simultaneous operation, endless conveyor band 10 conveying track sections 7 in the working direction at the same time that it conveys the new ties to the renewal site. Thus, the same freight cars are used for storage of the new ties and the old track sections. The new ties are laid at a desired spacing on the planed ballast bed in region 15 as they are continuously conveyed to this region. New rails 23 or 23' are then delivered from the train against the working direction in a known manner or they may be placed on the new ties from a storage site next to the track underneath rear undercarriage 3, whereupon the new rails are fastened to the new ties to complete the laying of the new track.

In the track renewal train of previously mentioned British Pat. No. 805,075, the freight cars transporting the old track sections from the renewal site back to a railyard, for instance, had to be brought back to the renewal site empty. With the system of this invention, these empty cars are loaded with new ties on their way back to the track renewal site. If the number of ties stored on each car conforms to that of the old track sections transported on each car, the track renewal will proceed without any empty cars. For instance, each rail freight car 20 may carry 120 ties, i.e. 15 ties per track section, and each car may be used to transport four superposed track sections of 18 m length. Spaced at a distance of 0.6 m, 120 ties produce a track length of 72 m, i.e. the same length freed by lifting 4 track sections of 18 m each off the ballast bed. This excellent use of loading space on the freight cars additionally reduces the amount of dead weight of the freight cars moved during the track renewal operation.

If the new ties are not conveyed to the renewal site in complete synchronization with the removal of the old track sections, bridge-like car 1, with its conveyor and transport means, is preferably so arranged that a number of new ties 11 corresponding to three to four track sections 7 may be stored on conveyor band 10. In other words, this number of new ties is removed from one of rail freight cars 20 before the track renewal operation begins and is ready to receive the old track sections at the beginning of the operation. In this manner, the new ties may be laid over a considerable length of track in a continuous manner and rails, of say, 120 m length may be placed on the newly laid ties and fastened thereto for the rapid production of a new track.

The illustrated arrangement for lifting and transporting old track sections 7 comprises fixed hoists 8 which lift each track section and suspend it on hooks 9 which then transport the lifted track section along path 12 to freight car 13. While this arrangement is very effective, it is also possible to mount hoists 8 movably along path 12. On car 13, the track section is transported further by means of conveyor band 19 and transport frames 21 which roll along guide tracks running along the lateral edges on car 13 and succeeding rail freight cars 20 until they are placed on a selected car. On their return, the transport frames 21 are used to bring back new ties 11 stored on cars 20, tools 24 on frames 21 being arranged for holding track sections 7 as well as new ties 11.

New rails 23 and 23' may be laid in any suitable manner well known in track renewal operations. For instance, they may also be stored on rail freight cars 20 and may be guided on suitable guide rollers along the sides of these cars towards region 15 where they are spread apart farther than the length of new ties 11 to enable the latter to be laid, whereupon the new rails are brought together to the desired track gage and laid on the new ties. Alternatively, the new rails may be stored in the center of the ballast bed or on its sides, and may then be laid in the proper gage on the new ties so that, after completion of the operation, the rear undercarriage 3 may run on the new track.

Obviously, the method and apparatus for track renewal hereinabove described is not limited to the specific embodiment illustrated. For instance, if desired, new ties 11 could be conveyed to renewal site 15 in a lengthwise position, i.e. oriented in the direction of the track, and a turntable may be mounted there to turn the ties 90° just before they are laid on the planed ballast bed. Various other structural modifications could be provided without departing from the spirit and scope of this invention, as defined in the appended claims.

What is claimed is:

1. A method of track renewal wherein a track consisting of old ties and rails is replaced by a track consisting of new ties and rails resting on a ballast bed, comprising the steps of moving a train of rail freight cars in a working direction over the track consisting of old ties and rails, coupling to a last one of the rail freight cars a bridge-like car having at respective ends thereof a rail-bound front undercarriage and a rail-bound rear undercarriage, and a bogie running on the ballast bed intermediate the rail-bound undercarriages, supporting the bridge-like car with the front undercarriage on the track consisting of old ties and rails and with the bogie on the ballast bed, separating the track consisting of old ties and rails into sections between the front undercarriage and the bogie, lifting the track sections off the ballast bed onto the bridge-like car, conveying the lifted track sections in the working direction from the bridge-like car to selected ones of the rail freight cars, storing new ties on the rail freight cars, simultaneously conveying successive ones of the new ties from selected ones of the rail freight cars against the working direction to the bridge-like car, lowering the successive new ties from the bridge-like car to the ballast bed between the bogie and the rear undercarriage, laying the new ties spaced along the ballast bed, the ballast bed having been planed before the new ties are lowered and laid on the planed ballast bed, laying new rails on the new ties between the bogie and the rear undercarriage, and fastening the new rails to the new ties.

2. A track renewal train for replacing a track consisting of old ties and rails with a track consisting of new ties and rails resting on a ballast bed, comprising a plurality of rail freight cars including a last freight car movable in a working direction over the track consisting of old ties and rails, new ties being stored on selected ones of the freight cars, a bridge-like car coupled to the last freight car and having at respective ends thereof a rail-bound front undercarriage and a rail-bound rear undercarriage, a bogie running on the ballast bed intermediate the rail-bound undercarriages, the bridge-like car being supported with the front undercarriage on the track consisting of old ties and rails and with the bogie on the ballast bed, means on the bridge-like car between the bogie and the front undercarriage for lifting a section of track consisting of old ties and rails off the ballast bed, means for transporting the lifted track section in the working direction from the bridge-like car to a selected one of the freight cars, an endless conveyor means mounted on the bridge-like car above the track section transporting means for conveying a succession of stored new ties against the working direction, the endless conveyor means having a front end projecting forwardly of the bridge-like car over the last freight car and a rear end extending to a region between the bogie and the rear undercarriage, means mounted in said region on the bridge-like car for lowering the conveyed new ties successively onto the ballast bed in selected spacing, and means for planing the ballast bed before the new ties are laid.

3. The track renewal train of claim 2, wherein the bogie is a selectively retractable track-laying vehicle and the ballast bed planing means comprises a plow attached to the front of the vehicle.

4. The track renewal train of claim 3, further comprising vibrating means for vibrating the vehicle whereby the planing effect is increased.

5. The track renewal train of claim 2, further comprising an endless conveyor on the last freight car arranged to receive the transported track section from the bridge-like car and to convey it in the working direction and new tie conveyor means for conveying the succession of new ties from the selected freight cars to the endless conveyor means on the bridge-like car.

6. A track renewal train of claim 5, wherein the new tie conveyor means comprises a turntable means associated with the tie conveyor means for turning successive ones of the new ties 90° from a conveying direction extending in the direction of the track to a laying direction extending transversely thereto.

* * * * *

UNITED STATES PATENT OFFICE

CERTIFICATE OF CORRECTION

PATENT NO. : 4,046,077

DATED : Sept. 6, 1977

INVENTOR(S) : Josef Theurer et al

It is certified that error appears in the above-identified patent and that said Letters Patent are hereby corrected as shown below:

In the heading, at /30/, change "Australia" to --Austria--

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*